United States Patent [19]

Manrubia

[11] Patent Number: 4,881,333

[45] Date of Patent: Nov. 21, 1989

[54] FRAME STABILIZING APPARATUS

[76] Inventor: Robert Manrubia, 422 Roading Dr., San Jose, Calif. 95123

[21] Appl. No.: 113,054

[22] Filed: Oct. 27, 1987

[51] Int. Cl.[4] ..... A47G 1/06

[52] U.S. Cl. ..... 40/152.1

[58] Field of Search ..... 40/155, 152.1, 594, 40/622; 248/467, 490, 497

[56] References Cited

U.S. PATENT DOCUMENTS

| | | | |
|---|---|---|---|
| 2,639,109 | 5/1953 | Hoag | 248/497 |
| 2,996,159 | 8/1961 | Casebolt | 40/156 |
| 4,568,055 | 2/1986 | Klitzky | 40/152.1 |

FOREIGN PATENT DOCUMENTS

| | | | |
|---|---|---|---|
| 353857 | 6/1961 | Switzerland | 248/490 |

*Primary Examiner*—Robert Peshock
*Assistant Examiner*—Cary E. Stone
*Attorney, Agent, or Firm*—Leona Gilden

[57] ABSTRACT

A frame stabilizing apparatus as set forth formed as "L" shaped members adhesively securable to corner portions of picture frames. Slots are formed at both terminal end portions of said "L" shaped members at the legs thereof, extending a finite distance into the legs. Heads of elements are positionable between the "L" shaped members and an associated picture frame enabling the tacks penetrating points to extend outwardly of said slots enabling securement of the pictue frame to an enjoining wall by the penetration of said tacks therein to stabilize a pictue frame.

4 Claims, 1 Drawing Sheet

FRAME STABILIZING APPARATUS

BACKGROUND OF THE INVENTION

1. Field of the Invention

The present invention relates to picture frame stabilizing apparatus, and more particularly pertains to a new and improved picture frame stabilizing apparatus which when adhesively secured to a picture frame captures tacks between the picture frame and legs of the "L" shaped stabilizing member to enable the projection of the tacks points beyond the stabilizing members and into an associated wall.

2. Description of the Prior Art

The use of picture frame stabilizing apparatus is well known in the prior art. As may appreciated, these devices have normally been of awkward construction or of construction integrally formed with an associated picture frame. It may be appreciated that it is desirable to provide a picture frame stabilizing apparatus that may be secured at a subsequent time to the construction of a picture frame enabling the stabilizing thereof and furthermore providing an apparatus of limited size and awkwardness to avoid visibility when utilized with a picture frame.

While supported framing is widespread among consumers in the hanging of pictures, diplomas and the like. Frequently due to disruptions, such as ordinary house cleaning or vibrations and the like, picture frames of this type as described are frequently disoriented with respect to their mounting requiring constant attention for the alignment thereof. In order to alleviate some of the problems associated with such constant maintenance of picture frame alignment, patents such as U.S. Pat. No. 3,789,527 to Mohr and U.S. Pat. No. 3,914,892 to Mohr also are provided wherein picture frames are formed with multiple support points to avoid the balancing of such framing devices but accordingly, the multiple hanging point type picture frames are more difficult to adjust, as opposed to a single point positioning support to create alignment of the picture frame along horizontal and vertical axis.

U.S. Pat. No. 4,017,989 to Murray illustrates a further example of picture framing techniques wherein an interlocking plurality of pictures are supported on a wall whereby alignment of the various frames as they are secured to one another maintains a predetermined alignment.

Further the patent to Russ, U.S. Pat. No. 4,450,637 and Buchanan, U.S. Pat. No. 4,477,990, are illustrative of picture frames utilized to provide rigid organization of the framed item but provide little means for maintaining alignment of such framed items.

It may be appreciated there is a continuing need for an improved picture frame stabilizing device which addresses both the problem of compactness and effectiveness in stabilizing a picture frame, and in this respect, the present invention substantially fulfills this need.

SUMMARY OF THE INVENTION

In view of the foregoing disadvantages inherent in the known types of picture frame stabilizing apparatus now present in the prior art, the present invention provides a picture frame stabilizing apparatus wherein the same may be compactly and efficiently positioned at opposed portions of a picture frame to stabilize this class of frames. As such, the general purpose of the present invention, which will be described subsequently in greater detail, is to provide a new and improved picture frame stabilizing apparatus which has all the advantages of the prior art frame stabilizing apparatus and none of the disadvantages.

To attain this, the present invention utilizes a pair of "L" shaped members having formed at remote portions of their legs thereof slits oriented parallel to said legs to accept securement elements, such as tacks, therein. A foam central portion of said "L" shaped members positions the aforenoted slots a distance approximating the thickness of the securement tacks from the surface of the picture frame wherein said foam or sponge-like material is generally adhesively bonded to said "L" shaped members and adhesively formed at its outer surface to be secured to a picture frame. Once the apparatus is positioned on an associated picture-like frame, the frame is merely hung on a wall in a conventional manner and upon slight pressure being imparted to the lowermost portion of the picture frame, the tack-like elements may penetrate the supporting wall to stabilize the picture frame for an indeterminate time frame.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved frame stabilizing apparatus which has all the advantages of the prior art frame stabilizing apparatus and none of the disadvantages.

It is another object of the present invention to provide a new and improved frame stabilizing apparatus which may be easily and efficiently manufactured and marketed.

It is a further object of the present invention to provide a new and improved frame stabilizing apparatus which is of a durable and reliable construction.

An even further object of the present invention is to provide a new and improved frame stabilizing apparatus which is susceptible of a low cost of manufacture with regard to both materials and labor, and which accordingly is then susceptible of low prices of sale to the consuming public, thereby making such frame stabilizing apparatus economically available to the buying public.

Still yet another object of the present invention is to provide a new and improved frame stabilizing apparatus which provides in the apparatuses and methods of the prior art some of the advantages thereof, while simultaneously overcoming some of the disadvantages normally associated therewith.

Still another object of the present invention is to provide a new and improved frame stabilizing apparatus which includes a pair of "L" shaped members adhesively secured to lowermost portions of a picture frame capturing a pair of tack-like members within each "L" shaped member.

Even still a further object of the present invention is to provide a new and improved frame stabilizing apparatus wherein a foam-like portion is adhesively secured to each "L" shaped member and thereafter securable to said picture frame by means of removable protective plastic strip.

These together with other objects of the invention, along with the various features of novelty which characterize the invention, are pointed out with particularity in the claims annexed to and forming a part of this disclosure. For a better understanding of the invemntion, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
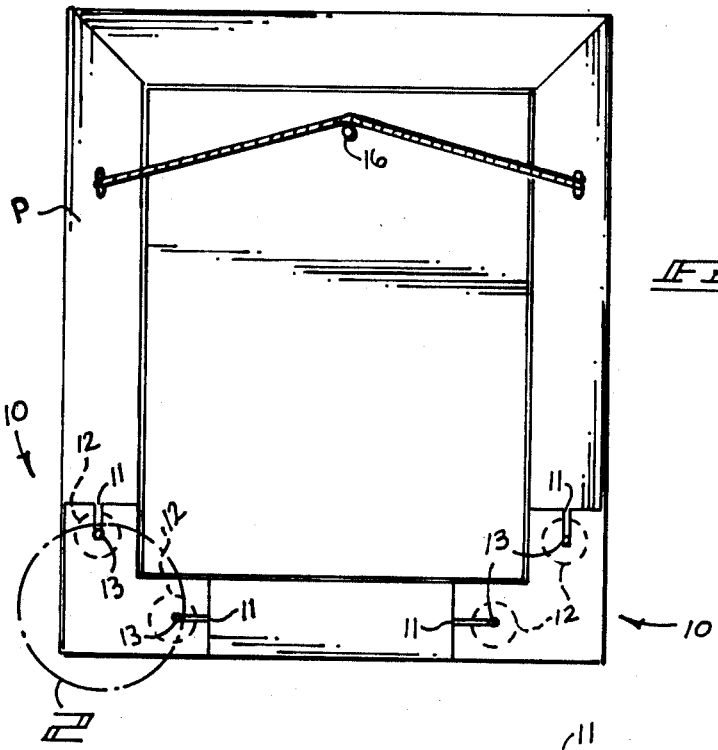
FIG. 1 is an orthographic view taken in elevation of the instant invention secured to lowermost portions of an associated picture frame.

With reference now to the drawings, and in particular to FIG. 1 thereof, a new and improved frame stabilizing apparatus embodying the principles and concepts of the present invention and generally designated by the reference numeral 10 will be described.

More specifically, it will be noted that the picture frame stabilizing apparatus 10 is secured to the lowermost rear surface corners of a picture frame "P". An elongate slit 11 is formed emanating from either terminal end of each leg of said "L" shaped picture frame stabilizing portion 10. In normal usage a pair of stabilizing members 10 are utilized in conjunction to secure said picture frame to an associated wall surface, but it may be realized of course that merely one of said "L" shaped portions will be adequate in performing that function. Positionable within said slits and securable between the surface of the picture frame "P" and the associated leg of the picture frame stabilizing portion 10 are tacks or the like 12 formed with projections 13.

Figure 4:
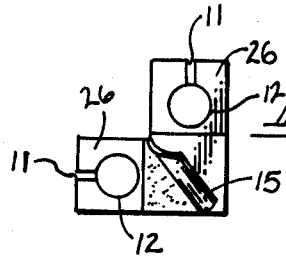
FIG. 4 is an orthographic top view of the present invention illustrating the backing tape partially removed to expose the adhesive foam-like material thereunder for securement to a picture frame.
Figure 2:
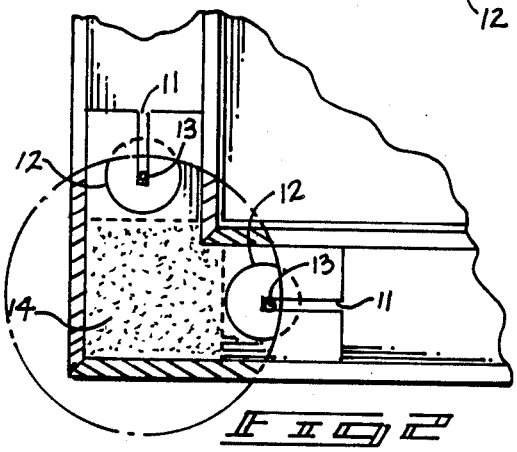
FIG. 2 is a partially cut-away view of the picture frame stabilizing apparatus, as illustrated in FIG. 1.
Figure 3:
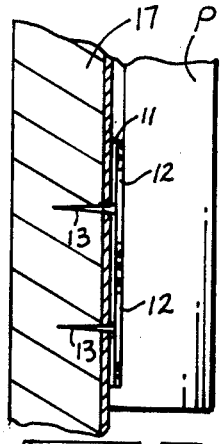
FIG. 3 is a side orthographic view of the present invention illustrating the securement elements positioned into an adjoining support wall.

A central portion of the "L" shaped picture frame stabilizing member 10 has secured thereto by adhesive or bonding methods generally a sponge-like portion 14 that is formed with a peel-away type layer 15 to enable immediate securement to the picture frame "P". As best illustrated in FIG. 4, a surface 26 is formed to include the terminal portions and slits 11 wherein the sponge-like portion 14 is not present. The difference in thickness of said sponge-like portion 14 and the surface 26 enables the tack-like elements 12 to be positionable within said slits 11 in an effective and convenient manner.

The exact positioning of the tack-like elements 12 within slits 11 is not critical in that the vertical slits, as illustrated in FIG. 1, prevent movement of the associated picture frame along a horizontal line and the horizontally oriented slits, as illustrated in FIG. 1, prevent vertical reorientation of the associated picture frame "P".

As to the manner of usage and operation of the present invention, the same should be apparent from the above description. However, a brief summary will be set forth as follows: The peel-away layer 15 is merely removed from either sponge-like portion 14 to expose the underlying adhesive as is commonly used wherein one merely positions the "L" shaped members at the opposed lowermost portions of a picture frame "P", as illustrated in FIG. 1. Tacks or the like are positioned within slits 11 and upon the appropriate number of tacks being positioned within said slits, the picture frame "P" is positioned on any suitable support element, such as a nail or hanger 16, and then the opposed lowermost corners of the picture frame "P" are imposed into the support surface or wall 17 and the picture frame "P" is thus permanently secured in position.

A further advantage of the present invention is that without the use of further connectors or adhesives, very minor pin holes are formed within the wall and if subsequent removal of the picture "P" is desired under normal circumstances, the thusly formed holes made by projections 13 become relatively unnoticeable.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A picture frame stabilizing apparatus in combination with a picture frame formed with a plurality of upper and lower corners and a rear perimeter surface wherein said picture frame stabilizing apparatus comprises, at least one "L" shaped means securable to a lowermost corner of said frame at a rear surface thereof, and said at least one "L" shaped means formed with a plurality of leg portions wherein each leg portion includes an elongate slit formed therein originating at terminal ends of said leg portions and extending inwardly along each leg portion of a distance substantially less than the length of each leg portion, and securement elements positionable within said slits for penetration of a rear support surface, and wherein each of said "L" shaped means includes an adhesive sponge-like portion formed at a rear surface of said "L" shaped means.

2. A picture frame stabilizing apparatus as set forth in claim 1 wherein the thickness of said sponge-like portion and a head of the securement means are of approximately the same thickness.

3. A picture frame stabilizing apparatus as set forth in claim 2 wherein said securement elements are in the form of tacks formed with said head and an orthogonally positioned projections.

4. A picture frame stabilizing apparatus as set forth in claim 3 wherein a peel-away layer is secured to said sponge-like portion wherein upon removal of said peel-away layer, adhesive is exposed for securement to said picture frame.

* * * * *